US008714358B2

(12) United States Patent
Debitzky

(10) Patent No.: US 8,714,358 B2
(45) Date of Patent: May 6, 2014

(54) EARPHONE PROTECTOR DEVICE

(76) Inventor: Béla Debitzky, Miami, FL (US)

( * ) Notice: Subject to any disclaimer, the term of this patent is extended or adjusted under 35 U.S.C. 154(b) by 0 days.

(21) Appl. No.: 13/463,876

(22) Filed: May 4, 2012

(65) Prior Publication Data

US 2012/0325701 A1 Dec. 27, 2012

Related U.S. Application Data

(60) Provisional application No. 61/501,329, filed on Jun. 27, 2011.

(51) Int. Cl.
*B65D 85/00* (2006.01)

(52) U.S. Cl.
USPC ..... 206/702; 206/409; 224/162; 224/666

(58) Field of Classification Search
USPC ..... 206/388, 408, 409, 38, 523, 389, 398, 206/53, 407, 702, 701, 320, 576; 220/817, 220/821, 822; 224/162, 666, 163, 182, 667, 224/269; 242/170
See application file for complete search history.

(56) References Cited

U.S. PATENT DOCUMENTS 3,256,892 A * 6/1966 Esposito, Jr. ..... 132/300
3,381,916 A * 5/1968 Edgell ..... 242/381.2
5,029,704 A * 7/1991 Stillinger ..... 206/702
5,669,571 A * 9/1997 Graybill ..... 242/378.1
5,802,237 A * 9/1998 Pulido ..... 385/135
6,522,613 B1 * 2/2003 Frankeny et al. ..... 720/655
6,571,804 B2 * 6/2003 Adler ..... 132/325
6,914,995 B2 * 7/2005 Kao ..... 381/370
2003/0098249 A1 * 5/2003 Rollock ..... 206/63.5
2006/0286894 A1 * 12/2006 Kelly ..... 446/295

* cited by examiner

*Primary Examiner* — Jacob K Ackun
*Assistant Examiner* — Jenine Pagan
(74) *Attorney, Agent, or Firm* — Robert M. Downey, P.A.

(57) ABSTRACT

An earphone protector device includes top and bottom compartments partitioned by and releasably attachable to opposite sides of a central partition member. A passage through the partition member is sized for insertion of earphone cords, wherein the corresponding earphones are located on the top side of the partition member and the earphone plug is located on the bottom side of the partition member. When used in conjunction with a portable media player, the earphones and earphone plug may be extended through slots located on each corresponding compartment, thereby limiting the amount of slack in the earphone cords during use. In another embodiment of the device, the central partition member does not include a passage and the device may be used for separately storing complimenting articles in the two compartments.

11 Claims, 5 Drawing Sheets

EARPHONE PROTECTOR DEVICE

BACKGROUND OF THE INVENTION

1. Field of the Invention

The present invention relates to earphone storage devices, and more particularly to an earphone protector device having two partitioned compartments sized to receive a set of earphones, the corresponding cords extending from each of the earphones, and the earphone plug.

2. Discussion of the Related Art

A traditional set of head phones comprises a pair of speakers that are used in connection with a signal source, such as a portable media player (e.g. iPod). Earphones, otherwise known as earbuds, are head phones designed to securely fit within a user's ears. Each of the earphone speakers typically have wiring within a wire jacket extending from the individual speaker to a single plug, which is inserted into the media player.

As earphone speakers are generally relatively small and fragile, a typical problem associated with earphones is their propensity to be broken when not in use. An additional problem arises when earphones are in use, wherein the wires extending from the earphones hang down from user's ears and often have so much slack that they sway with the user's movement, which can result in a wire becoming tangled with a nearby object.

A number of inventions have been directed towards a device for avoiding the above noted problems associated with earphones. One such device is provided in U.S. Pat. No. 6,658,130 to Huang, which discloses a receptacle for an earphone cord having a retractable earphone cord mounted within a front shell and a rear shell and a retracting spring in communication with a rolling disc for retracting the earphone cord. A hook is mounted on the outer surface for holding the earphone. While the '130 device is useful for its intended purpose, it does not provide optimal protection for two earphones while the earphones are not in use.

Therefore, there is exists a need for an improved earphone protector device that protects the earphones when the portable media player and earphones are not in use and further provides means for maintaining a limited amount of slack in the earphone cord during use.

OBJECTS AND ADVANTAGES OF THE PRESENT INVENTION

Considering the foregoing, it is a primary object of the present invention to provide an earphone protector device that safely protects and secures a set of earphones, earphone cords, and earphone plug when the earphones are not in use.

It is a further object of the present invention to provide an earphone protector device that separately holds the earphones in a first compartment and the corresponding earphone cords and earphone plug in a second compartment.

It is a further object of the present invention to provide an earphone protector device that is relatively inexpensive and easily manufactured.

It is a further object of the present invention to provide an earphone protector device that is not required to be disconnected from the earphones at any time, thereby limiting the likelihood of either the earphones or earphone protector device being misplaced.

It is still a further object of the present invention to provide an earphone protector device that limits the amount of slack in the earphone cord while a user uses the earphone protector device in conjunction with a portable media player.

These and other objects and advantages of the present invention are readily apparent with reference to the detailed description and accompanying drawings.

SUMMARY OF THE INVENTION

The present invention is directed to an earphone protector and storage device having a central partition member that creates two compartments for safely storing and protecting a set of earphones in a top compartment and the corresponding cords and earphone plug in a bottom compartment. A passage extending through the central partition member and in communication with both the top and bottom compartments is provided to allow the earphone cord to smoothly move from one compartment to the other compartment upon application of a gentle pulling force. The cord passage is accessible via a notch on one side of the central partition member. For storage, earphone cord is wound into a small coil (which can be accomplished by winding the cord around two fingers) and the coiled cord is placed in the bottom compartment while only the earphones are exposed the top compartment. Both of the compartments are then closed against the central partition member to protect the earphones from being damaged while not in use. The earphones may be accessed for use with a portable media player (e.g. iPod) by opening the bottom compartment and unwinding the earphone cord so that the earphone plug can be inserted into the portable media player, and opening the top compartment and pulling the earphones and earphone cord through the passage. Thereafter, the top and bottom compartments may be closed with segments of the earphone cord fitted within openings along the wall edges of each of the corresponding compartments. In another embodiment, the central partition member does not include a passage and may be used for separately storing complimenting articles, such as wet wipes and dry napkins or other complimentary items.

BRIEF DESCRIPTION OF THE DRAWINGS

For a fuller understanding of the nature of the present invention, reference should be made to the following detailed description taken in conjunction with the accompanying drawings in which.

Like reference numerals refer to like parts throughout the several views of the drawings.

DETAILED DESCRIPTION OF THE PREFERRED EMBODIMENT

Figure 1:
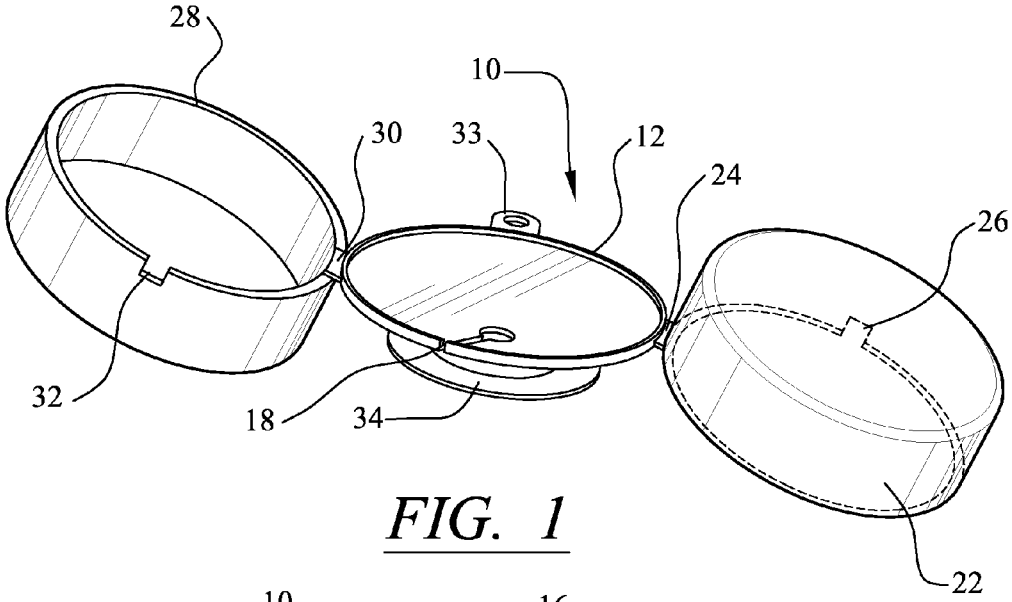
FIG. 1 is a side view of the earphone protector device of the present invention illustrating an open top compartment and an open bottom compartment.
Figure 2:
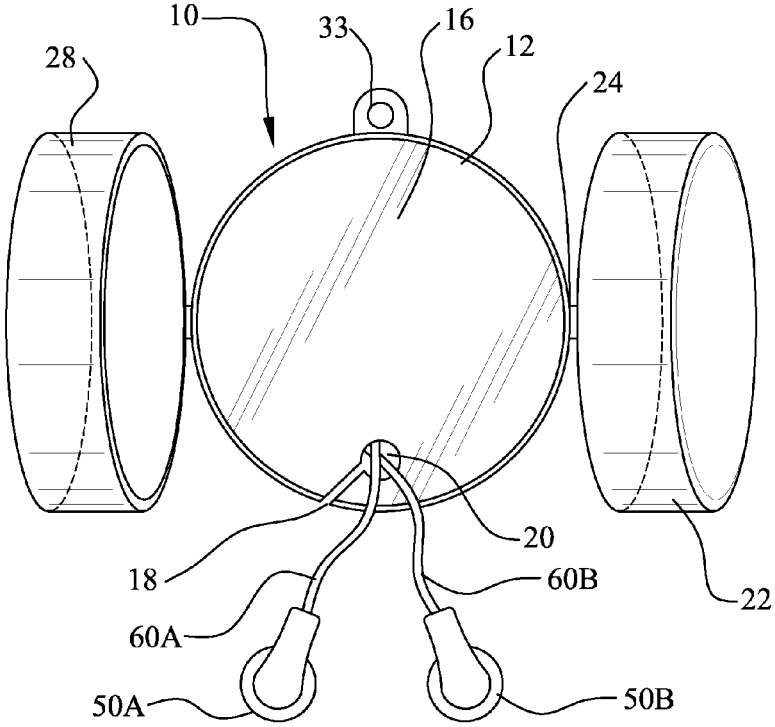
FIG. 2 is a top side perspective view of the earphone protector device of the present invention illustrating a central partition member with an open top compartment for securely protecting a set of earphones.
Figure 3:
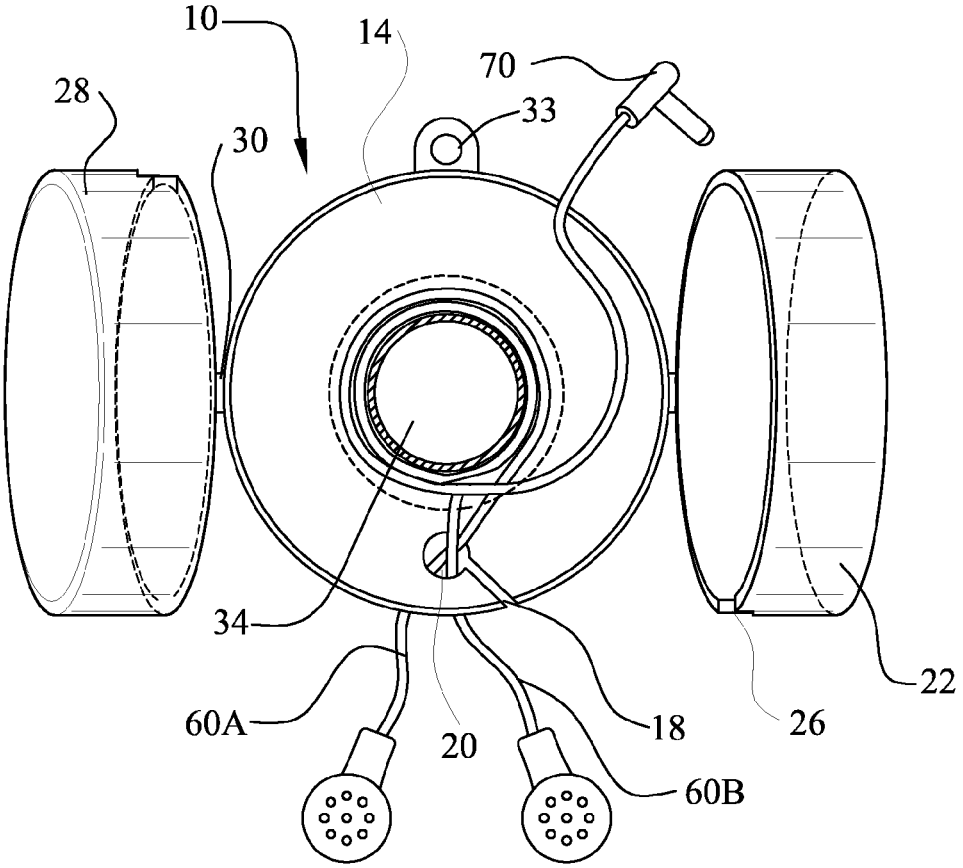
FIG. 3 is a bottom side perspective view of the earphone protector device of the present invention illustrating a central partition member having a winding spool for winding an earphone cord and an open bottom compartment for securely protecting the earphone cord and earphone plug.

Referring to the several views of the drawings, and initially FIGS. 1-3, the earphone protector device is shown and is generally indicated as 10. The earphone protector device 10 is used to securely protect a set of earphones 50A and 50B, as well as the corresponding earphone cords 60A and 60B and earphone plug 70.

The earphone protector device 10 includes a central partition member 12 having a bottom side 14 and a top side 16 made of a durable and solid material, such as plastic, and having a width approximately 2 millimeters thick. A narrow slot 18 is located on one side of the central partition member 12 for insertion of an earphone cords 60A and 60B, wherein the earphones 50A and 50B are oriented on the top side of the partition member 12 and the earphone plug 70 is oriented on the bottom side of the partition member 12, and provides access to a passage 20 for pulling the earphone cord 60 from the bottom side 14 to the top side 16 as needed. A bottom compartment 22 is secured to the bottom side 14 of the partition member 12 by a strap or living hinge 24 and is structured for closed attachment to the partition member 12. A slot 26 is included along the perimeter of the bottom compartment 22, sized for insertion of the earphone cords 60A and 60B when the bottom compartment 22 is open.

A top compartment 28 is secured to the top side 16 of the partition member 12 by a strap or living hinge 30 and is structured for closed attachment to the partition member 12. A slot 32 is included along the perimeter of the top compartment 28, sized for insertion of the earphone cords 60A and 60B when the top compartment 28 is open. An eyelet 33 extending from the top outer peripheral of the partition member 12 is provided for hanging the device 10 about a chain or necklace around a user's neck. In a preferred embodiment, the eyelet 33 is formed out of a tab with a hole extending therethrough.

Figure 4:
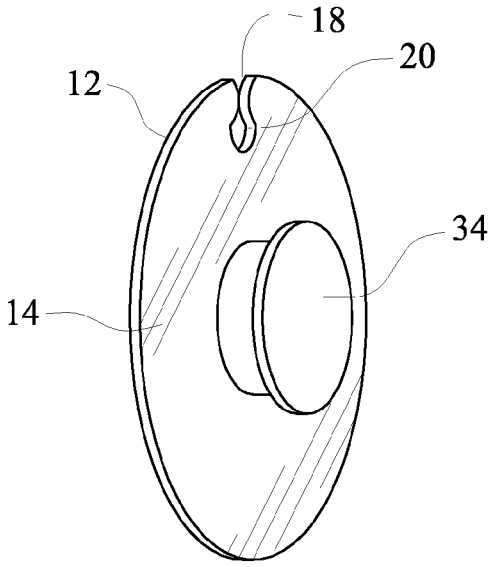
FIG. 4 is a perspective view of the central partition member, according to a further embodiment of the invention, illustrating a winding spool for winding the earphone cord.
Figure 5:
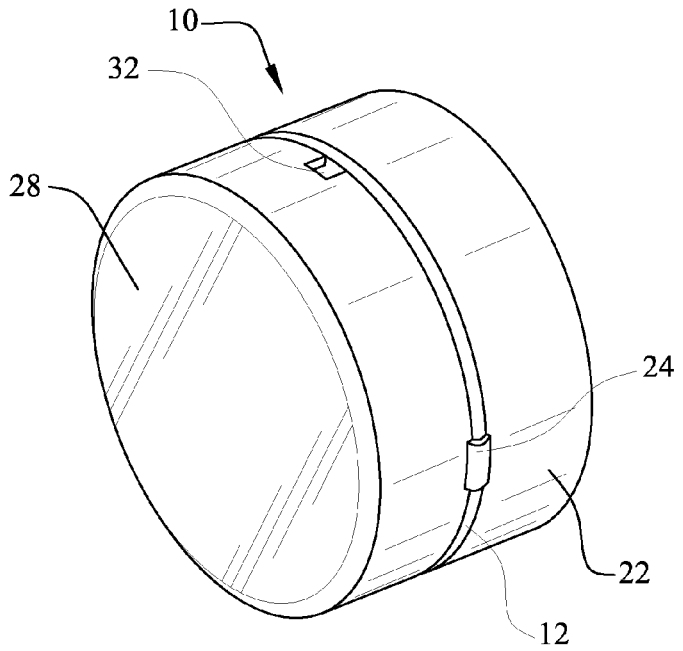
FIG. 5 is a perspective view of the earphone protector device of the present invention wherein the top and bottom compartments have been closed for protecting the earphones.

As shown in FIGS. 3 and 4, a winding spool 34 may be mounted to the bottom side 14 of the central partition member 12 for winding the earphone cords 60A and 60B into a neat coil so that the cords can be stored in the bottom compartment 22. After completely winding the earphone cords 60A and 60B around the spool 34 (shown in FIG. 3), wherein a minimal length of the earphone cords 60A and 60B is exposed on the top side 16 of the partition member, the bottom compartment 22 may be closed against the partition member 12 for safely securing the earphone cords 60A and 60B and earphone plug 70. The top compartment 28 may be closed as well for safely securing the earphones 50A and 50B within the top compartment 28, as shown in FIG. 5.

Figure 6:
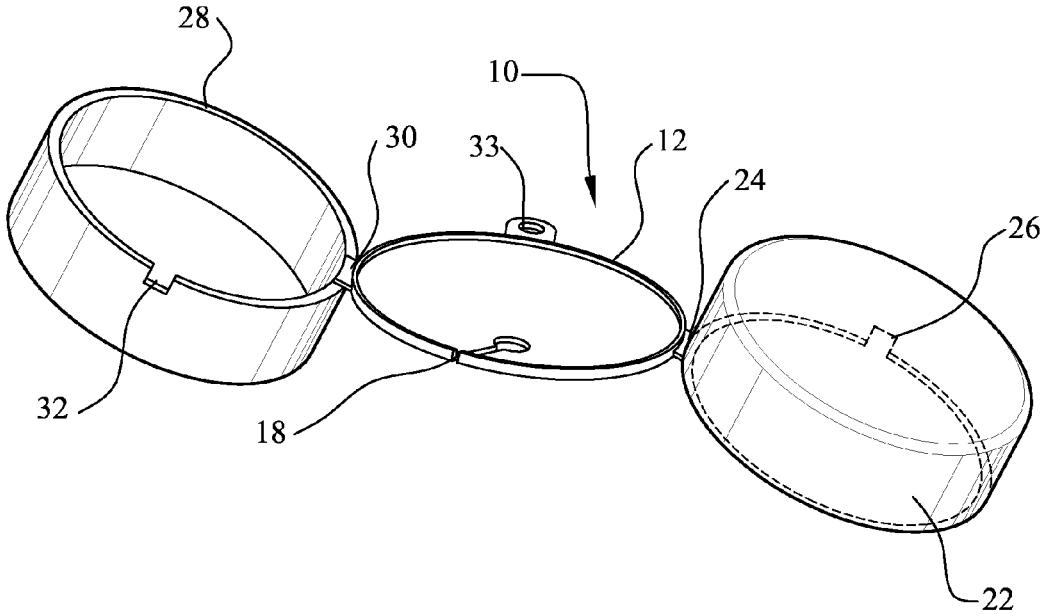
FIG. 6 is a side view of another embodiment of the earphone protector device of the present invention illustrating an open top compartment and an open bottom compartment.
Figure 7:
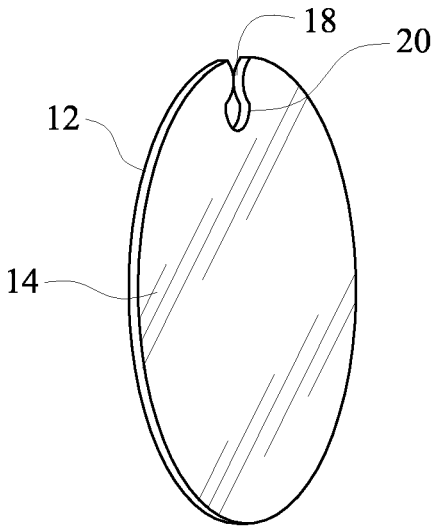
FIG. 7 is a perspective view of the central partition member shown in FIG. 6.

In another embodiment, shown in FIGS. 6 and 7, the bottom side 14 of the partition member 12 does not include the winding spool 34. To secure a set of earphones in compartments 22 and 28, the user winds the cords 60A and 60B around his or her finger and secures the cords 60A and 60B and plug 70 within the bottom compartment 22 and the earphones 50A and 50B within the top compartment 28, and then closes the compartments 22 and 28 against the central partition member 12.

Figure 8:
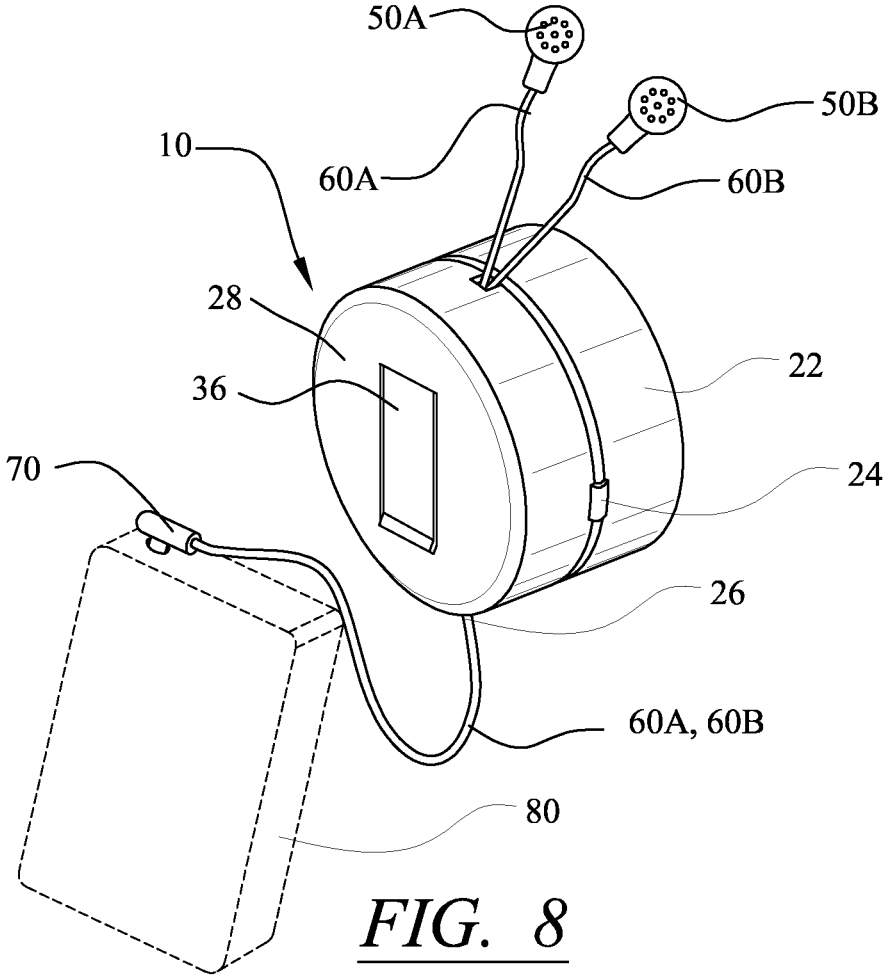
FIG. 8 is a front view of the earphone protector device of the present invention wherein a set of earphones is being used in conjunction with a portable media player.

Referring to FIG. 8, for use of the earphone protector device 10 in conjunction with a portable media player 80, the earphone cords 60A and 60B are unwound and the earphone cords 60A and 60B are fitted within the slot 26, after which the bottom compartment 22 is closed, thereby leaving the earphone plug 70 and a segment of each of the earphone cords 60A and 60B exposed. In the top compartment 28, the earphones 50A and 50B may be pulled to extend the length of each segment of the earphone cords 60A and 60B on the top side of the partition member 12. The earphone cords 60A and 60B are fitted with the slot 32 and the top compartment 28 is closed, thereby leaving the earphones 50A and 50B and a segment of each of the earphone cords 60A and 60B exposed. After a suitable amount of slack is present in the earphone cord 60, the earphones 50A and 50B may be inserted into the user's ears and the earphone plug 70 may be inserted into a portable media player 80 for use, as illustrated in FIG. 8.

In a preferred embodiment, an integrally formed clip 36 is provided on the outside of the bottom compartment, as illustrated in FIG. 8, for releasably securing the earphone protector device 10 to the user's clothing during use with a portable media player 80.

Figure 9:
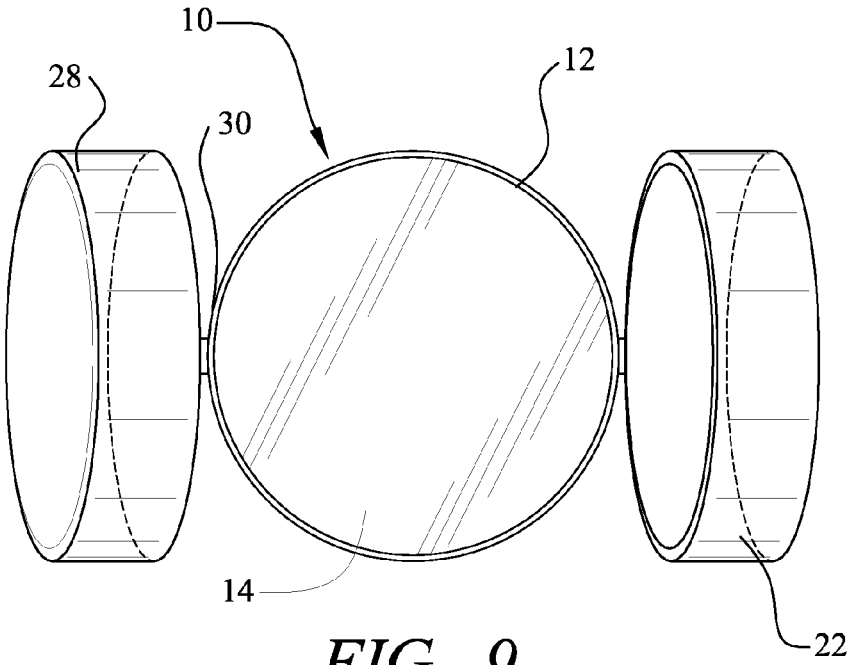
FIG. 9 is a bottom side perspective view of another embodiment of the earphone protector device illustrating a central partition member of the device without a passage and compartments without slots.
Figure 10:
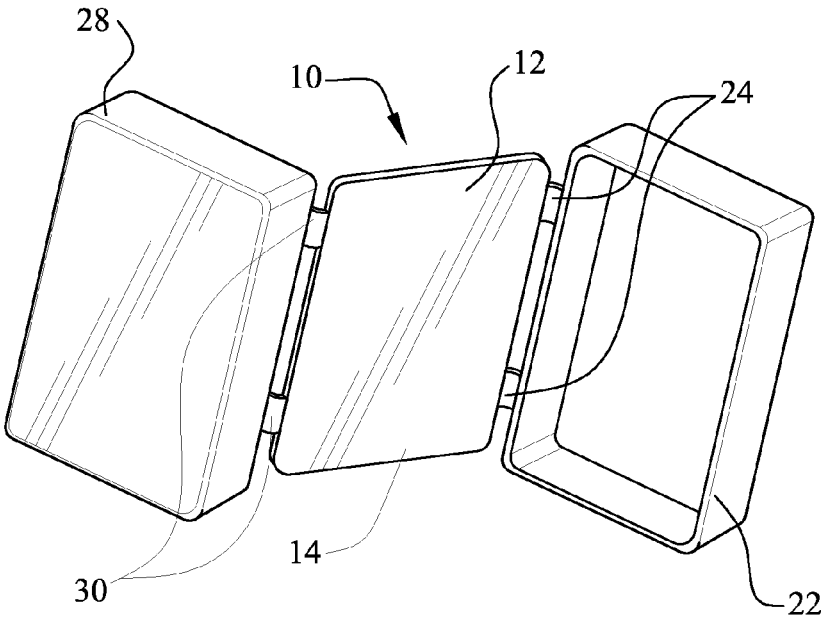
FIG. 10 is a bottom side perspective view of another embodiment of the earphone protector device illustrating a central partition member without a passage and compartments without slots.

Referring to FIGS. 9 and 10, further embodiments of the device 10 are shown wherein the partition member 12 does not include a passage 20 or a winding spool 34 and may be used for secured storage of articles other than earphones. For example, this embodiment may be used for securely storing complementing articles such as wet wipes and dry napkins in separate compartments 22 and 28.

Although the central partition member 12 and the bottom and top compartments 22 and 28 comprising the earphone protector device 10 and depicted in FIGS. 1-9 are generally cylindrical in shape, alternative shapes, such as a rectangular shape (shown in FIG. 10) and other geometrical shapes, may be used as well in forming the earphone protector device 10.

While the present invention has been shown and described in accordance with several preferred and practical embodiments, it is recognized that departures from the instant disclosure are contemplated within the spirit and scope of the present invention which are not to be limited except as defined in the following claims as interpreted under the Doctrine of Equivalents.

What is claimed is:

1. An earphone protector device for storing a set of earphones and earphone cords, and said device comprising:

a main case body including a first cover member having a first interior compartment and an opening surrounded by a peripheral rim, a second cover member having a second interior compartment and an opening surrounded by a peripheral rim, and a central partition member having an outer peripheral edge, a first side face surrounded by a first peripheral edge zone and an oppositely disposed second side face surrounded by a second peripheral edge zone and a thickness defined between the opposite first and second side faces, and said first peripheral edge zone of said central partition member being releasably attachable to said peripheral rim of said first cover member so that said central partition member can cover said opening and close said first interior compartment and uncover said opening and open said first interior compartment, and said second peripheral edge zone of said central partition member being releasably attachable to said peripheral rim of said second cover member so that said central partition member can cover said opening and close said second interior compartment and uncover said opening and open said second interior compartment;

said central partition member being hingedly attached to said first cover member at a first hinge location, and said central partition member being hingedly attached to said second cover member at a second hinge location independent of said first hinge location, to thereby allow said first and second cover members to be operatively and independently moveable relative to said central partition member in order to selectively and independently open and close said first and second interior compartments, and said central partition member including a slot on the outer peripheral edge and communicating with an opening through the thickness of said central partition member, and said slot and said opening being sized and configured for fitted insertion of the earphone cords through said slot and into said opening for allowing passage of the earphone cords through said central partition member; and a slot on each of said first and second cover members, and each of said slots being defined by an opening on said peripheral rim of said first and second cover members, and a first of said slots being sized and configured for passage of a first segment of the earphone cords and a second of said slots beings sized and configured for passage of a second segment of the earphone cords, and said slots being aligned in diametrically opposing relation so that the first segment of the earphone cords extends upwardly when said first and second interior compartments are closed and the second segment of the earphone cords extends downwardly when said first and second interior compartments are closed, and a portion of the earphone cords is held in said first and second compartments when said first and second interior compartments are closed.

2. The earphone protector device as recited in claim 1 wherein said first hinge location and said second hinge location are located on opposite sides of said central partition member.

3. The earphone protector device as recited in claim 1 further comprising a winding spool on said first side of said central partition member, and said winding spool be structured and disposed for winding the earphone cords around so that the cords can be stored in said first interior compartment.

4. The earphone protector device as recited in claim 1 further comprising a clip on said main case body, and said clip being structured and disposed for releasably securing said earphone protector device to a user's clothing.

5. The earphone protector device as recited in claim 1 further including an eyelet comprising a tab extending from the outer peripheral edge of said central partition member and having a hole extending therethrough, said hole being sized to receive a chain for securing said earphone protector device to the chain.

6. An earphone protector device for storing a set of earphones and earphone cords, and said device comprising:

a main case body including a first cover member having a first interior compartment and an opening surrounded by a peripheral rim, a second cover member having a second interior compartment and an opening surrounded by a peripheral rim, and a central partition member having an outer peripheral edge, a first side face surrounded by a first peripheral edge zone and an oppositely disposed second side face surrounded by a second peripheral edge zone and a thickness defined between the opposite first and second side faces, and said first peripheral edge zone of said central partition member being releasably attachable to said peripheral rim of said first cover member so that said central partition member can cover said opening and close said first interior compartment and uncover said opening and open said first interior compartment, and said second peripheral edge zone of said central partition member being releasably attachable to said peripheral rim of said second cover member so that said central partition member can cover said opening and close said second interior compartment and uncover said opening and open said second interior compartment;

said central partition member being hingedly attached to said first cover member at a first hinge location, and said central partition member being hingedly attached to said second cover member at a second hinge location independent of said first hinge location, to thereby allow said first and second cover members to be operatively and independently moveable relative to said central partition member in order to selectively and independently open and close said first and second interior compartments, and said central partition member including a slot on the outer peripheral edge and communicating with an opening through the thickness of said central partition member, and said slot and said opening being sized and configured for insertion of the earphone cords through said slot and into said opening for allowing passage of the earphone cords through said central partition member; and a slot on each of said first and second cover members, and each of said slots being defined by an opening on said peripheral rim of said first and second cover members, and a first of said slots being sized and configured for passage of a first segment of the earphone cords and a second of said slots beings sized and configured for passage of a second segment of the earphone cords.

7. The earphone protector device as recited in claim 6 wherein each of said slots are aligned in diametrically opposing relation so that the first segment of the earphone cords extends upwardly when said first and second interior compartments are closed and the second segment of the earphone cords extends downwardly when said first and second interior compartments are closed, and a portion of the earphone cords is held in said first and second compartments when said first and second interior compartments are closed.

8. The earphone protector device as recited in claim 6 wherein said first hinge location and said second hinge location are located on opposite sides of said central partition member.

9. The earphone protector device as recited in claim 6 further comprising a winding spool on said first side of said central partition member, and said winding spool be structured and disposed for winding the earphone cords around so that the cords can be stored in said first interior compartment.

10. The earphone protector device as recited in claim 6 further comprising a clip on said main case body, and said clip being structured and disposed for releasably securing said earphone protector device to a user's clothing.

11. The earphone protector device as recited in claim 6 further including an eyelet comprising a tab extending from the outer peripheral edge of said central partition member and having a hole extending therethrough, said hole being sized to receive a chain for securing said earphone protector device to the chain.

* * * * *